US011753276B2

(12) United States Patent
Humbert et al.

(10) Patent No.: US 11,753,276 B2
(45) Date of Patent: Sep. 12, 2023

(54) ELEVATOR LOAD BEARING MEMBER HAVING A FABRIC STRUCTURE

(71) Applicant: OTIS ELEVATOR COMPANY, Farmington, CT (US)

(72) Inventors: Michael Paul Humbert, Wethersfield, CT (US); Scott Alan Eastman, Glastonbury, CT (US); Daniel A. Mosher, Glastonbury, CT (US); Wenping Zhao, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 1134 days.

(21) Appl. No.: 16/430,989

(22) Filed: Jun. 4, 2019

(65) Prior Publication Data

US 2020/0385237 A1 Dec. 10, 2020

(51) Int. Cl.

| | |
|---|---|
| ***B66B 7/06*** | (2006.01) |
| ***D07B 1/02*** | (2006.01) |
| ***D07B 5/04*** | (2006.01) |
| ***D03D 15/60*** | (2021.01) |
| ***D03D 15/292*** | (2021.01) |
| *D06N 3/00* | (2006.01) |

(52) U.S. Cl.

CPC ..... *B66B 7/062* (2013.01); *D03D 15/292* (2021.01); *D03D 15/60* (2021.01); *D07B 1/02* (2013.01); *D07B 5/045* (2021.01); *D06N 3/0006* (2013.01); *D07B 2201/20903* (2015.07); *D07B 2501/2007* (2013.01)

(58) Field of Classification Search

CPC ..... B66B 7/062; D07B 1/02; D07B 5/045; D07B 2201/20903; D07B 2501/2007; D03D 15/60; D03D 15/292; D06N 3/0006

See application file for complete search history.

(56) References Cited

U.S. PATENT DOCUMENTS

2017/0101293 A1* 4/2017 Eastman ..... D03D 15/43
2019/0084803 A1* 3/2019 Eastman ..... B66B 9/00

FOREIGN PATENT DOCUMENTS

EP 2569243 * 9/2010
WO WO2013105958 * 7/2013
WO 2015/126359 A1 8/2015

OTHER PUBLICATIONS

Extended European Search Report for Application No. EP 19 21 9676 dated Aug. 28, 2020.

* cited by examiner

*Primary Examiner* — Cephia D Toomer
(74) *Attorney, Agent, or Firm* — Carlson, Gaskey & Olds, P.C.

(57) ABSTRACT

An illustrative example embodiment of an elevator load bearing member includes a plurality of load bearing cords and a woven fabric including a plurality of warp yarns along a length of the load bearing member and a plurality of weft yarns transverse to the length of the load bearing member. The woven fabric includes a central portion and lateral edge portions extending along the length of the load bearing member. The central portion includes the load bearing cords interlaced with the woven fabric. The lateral edge portions each include terminal ends of the weft yarns. The central portion has a first plurality of warp yarns situated between laterally outermost ones of the cords. The lateral edge portions have a second plurality of warp yarns between the laterally outermost ones of the cords and the terminal ends of the weft yarns.

20 Claims, 3 Drawing Sheets

ELEVATOR LOAD BEARING MEMBER HAVING A FABRIC STRUCTURE

BACKGROUND

A variety of elevator systems are known. Some elevator systems use a hydraulic arrangement for moving the elevator car. Others are traction-based and include roping that suspends the elevator car and a counterweight. A machine causes movement of a traction sheave that, in turn, causes movement of the roping for moving the elevator car as desired.

For many years, roping in elevator systems included round steel ropes. More recently, flat belt technologies were developed that provided advantages over traditional, round steel rope arrangements. Even with the advancement, those skilled in the art have been striving to improve elevator load bearing member technology.

SUMMARY

An illustrative example embodiment of an elevator load bearing member includes a plurality of load bearing cords and a woven fabric including a plurality of warp yarns along a length of the load bearing member and a plurality of weft yarns transverse to the length of the load bearing member. The woven fabric includes a central portion and lateral edge portions extending along the length of the load bearing member. The central portion includes the load bearing cords interlaced with the woven fabric. The lateral edge portions each include terminal ends of the weft yarns. The central portion has a first plurality of warp yarns situated between laterally outermost ones of the cords. The lateral edge portions have a second plurality of warp yarns between the laterally outermost ones of the cords and the terminal ends of the weft yarns.

In an example embodiment having one or more features of the elevator load bearing member of the previous paragraph, the warp yarns in the lateral edge portions interlock the weft yarns together.

In an example embodiment having one or more features of the elevator load bearing member of any of the previous paragraphs, at least some of the warp yarns in the lateral edge portions are interlocked with the weft yarns in a first manner and at least some others of the warp yarns in the lateral edge portions are interlocked with the weft yarns in a second, different manner.

In an example embodiment having one or more features of the elevator load bearing member of any of the previous paragraphs, the at least some of the warp yarns in the lateral edge portions are woven together with the weft fibers and the at least some others of the warp yarns in the lateral edge portions are stitched together with the weft fibers.

In an example embodiment having one or more features of the elevator load bearing member of any of the previous paragraphs, at least some of the yarns have a first melting temperature that is higher than a second melting temperature of at least some others of the yarns.

In an example embodiment having one or more features of the elevator load bearing member of any of the previous paragraphs, the at least some others of the yarns are at least partially melted thereby bonding the yarns together.

In an example embodiment having one or more features of the elevator load bearing member of any of the previous paragraphs, the woven fabric includes at least some thermoplastic that is at least partially melted.

An example embodiment having one or more features of the elevator load bearing member of any of the previous paragraphs includes an adhesive that at least partially bonds the yarns together.

In an example embodiment having one or more features of the elevator load bearing member of any of the previous paragraphs, the cords include a coating that is configured to at least partially melt and bond to the woven fabric.

An illustrative example embodiment of a method of making an elevator load bearing member includes weaving a fabric of a plurality of warp yarns and a plurality of weft yarns, wherein the warp yarns extend along a length of the load bearing member and the weft yarns are transverse to the length of the load bearing member, interlacing a plurality of load bearing cords within a central portion of the woven fabric, situating a first plurality of warp yarns in the central portion of the woven fabric between laterally outermost ones of the cords, and situating a second plurality of warp yarns in lateral edge portions of the woven fabric. The lateral edge portions include terminal ends of the weft yarns and the second plurality of warp yarns are between the laterally outermost ones of the cords and the terminal ends of the weft yarns.

In an example embodiment having one or more features of the method of the previous paragraph, the weaving includes positioning opposite ends of each of the weft yarns in the lateral edge portions, respectively.

In an example embodiment having one or more features of the method of any of the previous paragraphs, the weaving is performed with a shuttleless loom.

An example embodiment having one or more features of the method of any of the previous paragraphs includes arranging a first plurality of cords parallel to each other, arranging a second plurality of cords parallel to each other, weaving the fabric such that the first and second pluralities of cords are respectively interlaced with the woven fabric with a section of the woven fabric having the second plurality of warp yarns between the first plurality of cords and the second plurality of cords, and cutting the section of the woven fabric establishing a first load bearing member including the first plurality of cords and a separate second load bearing member including the second plurality of cords.

An example embodiment having one or more features of the method of any of the previous paragraphs includes bonding at least some of the yarns together in the section of the woven fabric while performing the cutting.

In an example embodiment having one or more features of the method of any of the previous paragraphs, bonding the at least some of the yarns comprises at least partially melting the at least some of the yarns.

In an example embodiment having one or more features of the method of any of the previous paragraphs, the cut section establishes at least one of the lateral edge portions of the first load bearing member and at least one of the lateral edge portions of the second load bearing member.

In an example embodiment having one or more features of the method of any of the previous paragraphs, the cutting establishes one of the terminal ends of each of the weft yarns of the first load bearing member and one of the terminal ends of each of the weft yarns of the second load bearing member.

In an example embodiment having one or more features of the method of any of the previous paragraphs, at least some yarns have a melting temperature that is lower than another melting temperature of at least some other yarns and the method comprises heating the woven fabric to a temperature to at least partially melt the some of the yarns and at least partially bond the yarns together.

An example embodiment having one or more features of the method of any of the previous paragraphs includes at least partially bonding the yarns together and wherein the bonding comprises using an adhesive.

In an example embodiment having one or more features of the method of any of the previous paragraphs, the cords include a coating and the method comprises at least partially melting the coating.

The various features and advantages of at least one disclosed example embodiment will become apparent to those skilled in the art from the following detailed description. The drawings that accompany the detailed description can be briefly described as follows.

DETAILED DESCRIPTION

Figure 1:
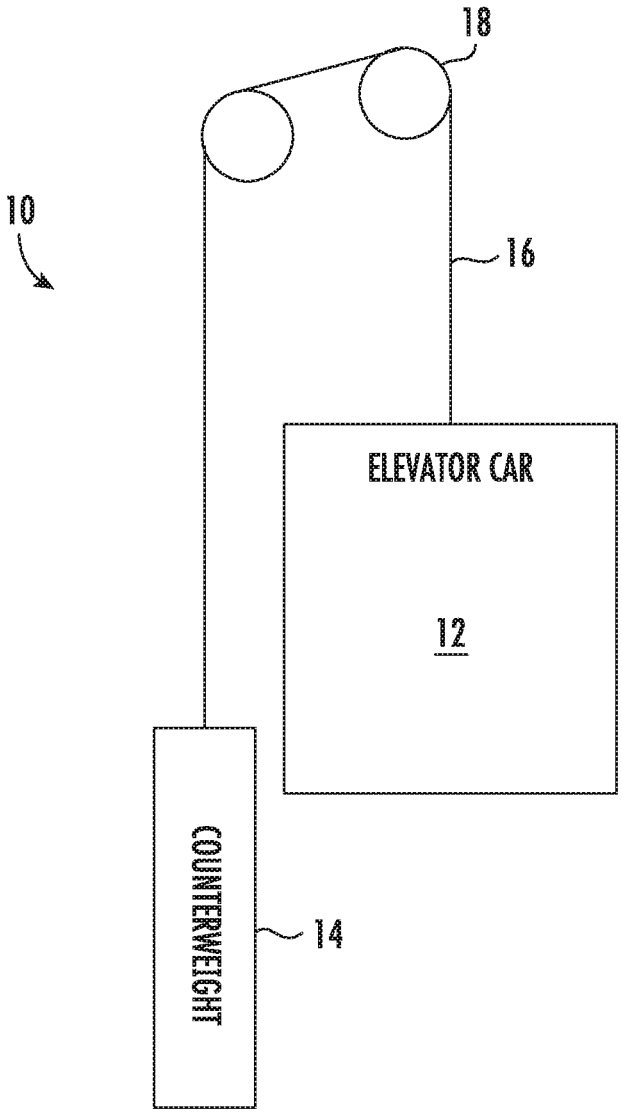
FIG. 1 schematically illustrates selected portions of an elevator system including a load bearing member designed according to an embodiment of this invention.

FIG. 1 schematically shows selected portions of an elevator system 10. An elevator car 12 and counterweight 14 are suspended by a load bearing member 16. A traction sheave 18 associated with a machine (not specifically illustrated) selectively controls movement of the load bearing member 16 to control the movement or position of the elevator car 12. For illustration purposes, a single load bearing member 16 is represented in FIG. 1. Multiple load bearing members would be included in many embodiments.

Figure 2:
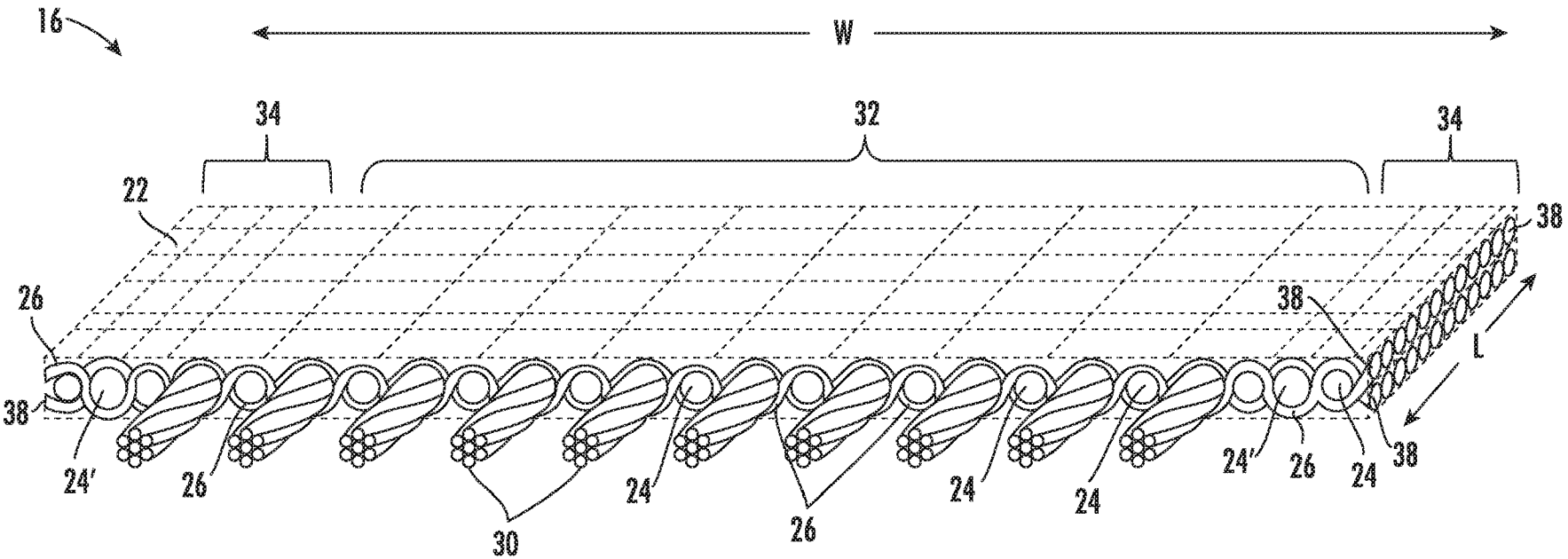
FIG. 2 schematically illustrates an example embodiment of an elevator load bearing member.

FIG. 2 schematically illustrates an example load bearing member 16. A woven fabric 22 includes a plurality of warp yarns 24 and a plurality of weft yarns 26. The warp yarns 24 extend along a length L of the load bearing member 16 and the weft yarns 26 are transverse to the length L. A plurality of cords 30, which are the primary load bearing elements of the illustrated example embodiment, are interlaced with the yarns of the woven fabric 22. The cords 30 are parallel to each other and extend along the length L of the load bearing member 16.

A central portion 32 of the woven fabric 22 includes a first plurality of warp yarns 24 and the cords 30. The first plurality of warp yarns 24 are all situated between the laterally outermost cords 30. The first plurality of warp yarns 24 result from a weaving process of establishing the woven fabric.

Lateral edge portions 34 are situated along the sides of the load bearing member 16 and next to the laterally outermost cords 30. The lateral edge portions 34 each include a second plurality of warp yarns 24 that are between the laterally outermost cords 30 and free or terminal ends 38 of the weft yarns 26. In the illustrated example, there are three warp yarns 24 in each of the lateral edge portions 34.

The second plurality of warp yarns 24 in each lateral edge portion 34 contribute to maintaining the integrity of the load bearing member 16. The illustrated example woven fabric 22 is established using a shuttleless loom, such as a rapier, projectile, or water jet loom. Such looms leave open, free or terminal ends of the weft yarns 26 along the outside of the lateral edges. In the illustrated embodiments, the opposite free ends of each weft yarn 26 are situated in the lateral edge portions 34, respectively. Including the second pluralities of warp yarns 24 within the lateral edge portions 34 reinforces the lateral edges of the load bearing member 16 and contributes to the performance and integrity of the load bearing member 16 over time. The second pluralities of warp yarns 24 within the lateral edge portions 34 may be considered warp interlocks for interlocking the weft yarns 26 together within the lateral edge portions 34.

In some embodiments, additional yarns or yarns are included within the lateral edge portions 34 utilizing a stitching technique so that the second plurality of warp yarns 24 are not interlocked with the weft yarns 26 in the same manner as the warp yarns 24 that are included in the central portion 32. Some additional yarns within the lateral edge portions 34 may be situated parallel to the cords 30 to provide additional reinforcement to the woven fabric 22 without being interlocked with the weft yarns 26.

One aspect of the disclosed example embodiment is that the weft yarns 26 are not the only yarns laterally outside of the cords 30. If a shuttle loom were used, by contrast, the weft yarns 26 would wrap around the outermost cords 30 and continue along the length of the woven fabric in a repeated fashion resulting in a selvage along the edges of the fabric that is received against the laterally outermost cords 30. Instead of such an arrangement, the disclosed example embodiment includes the second plurality of warp yarns 24 situated between the outermost cords 30 and the terminal ends 38 of the weft yarns 26 with terminal ends of the weft yarns 26 in the lateral edge portions 34. There is no selvage in the disclosed example embodiment.

Figure 3:
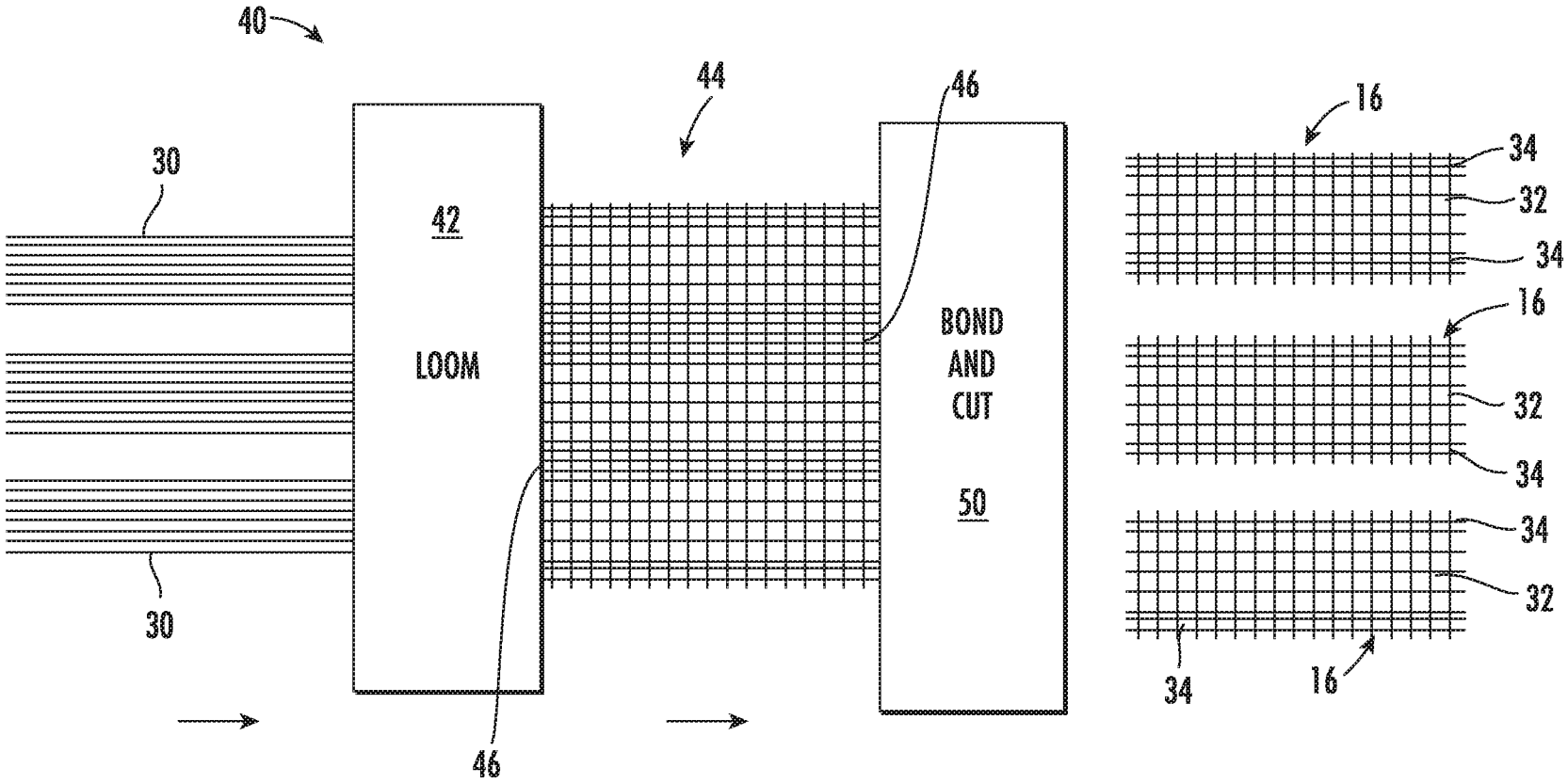
FIG. 3 schematically illustrates selected features of a process for making an elevator load bearing member like that shown in FIG. 2.

A method of making a load bearing member 16 consistent with that shown in FIG. 2 is schematically illustrated at 40 in FIG. 3. In this example, multiple sets of cords 30 are arranged with the cords 30 parallel to each other. In this example there is a first plurality of cords, a second plurality of cords and a third plurality of cords 30. The cords 30 are fed into a shuttleless loom 42 where the cords 30 are interlaced with the yarns of the woven fabric.

The woven structure 44 provided by the loom 42 is a woven fabric that includes each of the sets or pluralities of cords 30 and warp and weft yarns with sections 46 between the portions that include the cords 30. The sections 46 have the second pluralities of warp yarns 24. The second pluralities of warp yarns 24 may be included in the woven structure 44 by a shuttleless loom during the weaving process or may be introduced into the fabric using another device or technique within the loom 42 schematically represented in FIG. 3.

The woven structure 44 is processed by a bonding and cutting station 50. Cutting the structure 44 along the sections 46 separates the structure 44 into multiple load bearing members 16. Each of the resulting load bearing members 16 includes a central portion 32 including the corresponding plurality of cords 30 and first plurality of warp yarns 24. Each resulting load bearing member 16 also has two lateral edge portions 34 that each include terminal ends 38 (FIG. 1) of the weft yarns 26 and the respective second plurality of warp yarns 24.

At least some of the woven yarns are at least partially bonded together. This bonding is accomplished in some embodiments by at least partially melting at least some of the yarns 24, 26. In some example embodiments, the woven fabric yarns are at least partially meltable or fusible to bond at least some of the yarns together. In some example embodiments, at least some of the yarns comprise a material that has a lower melting temperature than other yarns so that the yarns with the lower melting temperature will at least partially melt for bonding at least some of the yarns together without distorting or compromising the yarns that do not melt. The temperature that the woven structure 44 is exposed to in the bonding and cutting station is high enough to at least partially melt the yarns that have the lower melting temperature.

The cords 30 are also coated with a coating that facilitates bonding the cords to the woven fabric 22. The cord coating may be at least partially meltable or fusible and is heated at the same time that the yarns are heated. Some cord coatings include one material that is at least partially melted during the bonding process and another coating material that remains undisturbed or unchanged during the bonding process.

The bonding and cutting may occur simultaneously and, in embodiments that include at least partially melting the yarns, a hot cutting blade fuses together the yarns along the outer limits of the lateral edge portions 34.

In some embodiments the yarns are coated or infused with a lower melting temperature material that serves as a bonding agent when it is melted. Such a bonding agent may be added as part of the yarn manufacturing process or added after the woven structure 44 exits the loom 40 and before it enters the bonding and cutting station 50. For example, a polymeric sheet may be situated on the woven structure 44 and infused into the yarns by heating and melting the sheet.

In other embodiments a low viscosity solution coating is applied to the yarns and then dried in the bonding and cutting station 50. Such a coating may be applied after cutting the sections 46 to further reinforce the lateral edge portions 34.

Some example embodiments include an adhesive on at least some of the yarns or an adhesive applied in the bonding and cutting station 50 for bonding together yarns. In some example embodiments, at least one thermoplastic polyurethane insert is included in the woven structure 44. Such an insert at least partially melts within the bonding and cutting station 50 and serves to bond the yarns together.

The bonding of the woven fabric yarns in the lateral edge portions 34 contributes to providing secure and robust woven fabric edges even though open or terminal ends 38 of the weft yarns 26 are situated in the lateral edge portions 34.

One feature of the disclosed example embodiment shown in FIG. 1 is that at least one of the second plurality of warp yarns 24' in each lateral edge portion 34 has a higher denier (i.e., diameter) than other warp yarns 24 in the woven fabric. The higher denier warp yarns 24' may provide additional reinforcement of the weft yarns 26 in the lateral edge portions compared to smaller denier yarns in some embodiments.

Some embodiments includes a first number of warp yarns 24 per unit volume in the central portion 32 and a second, larger number of warp yarns 24 per unit volume in the lateral edge portions 34. Including a second, larger number of warp yarns 24 per unit volume in some embodiments is realized by including a higher EPI (ends per inch) in the lateral edge portions 34 compared to the central portion 32. In the fabric industry EPI is used to denote the number of warp yarns per unit width, such as per inch.

An elevator load bearing member like that described above and schematically shown in FIG. 2 has the features and performance characteristics of a woven fabric-style belt and can be made using a process like that described above and schematically shown in FIG. 3 to realize efficiencies when making such load bearing members. Using a shuttleless loom allows for faster processing and reduced cost, which are both desirable. Including a second plurality of warp yarns in the lateral edge portions to serve as interlocks for reinforcing the weft yarns 26 is a unique and secure arrangement of warp yarns in a load bearing member such as a flat belt. Such embodiments provide extended service life of a fabric-coated belt or rope.

Embodiments consistent with this disclosure also provide a load bearing assembly that has greater flexibility and is capable of wrapping around relatively smaller sheaves, which allows for using reduced motor sizes, compared to stiffer roping or belt configurations. These features provide additional cost savings in an elevator system.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator load bearing member, comprising:

a plurality of load bearing cords;

a woven fabric including a plurality of warp yarns along a length of the load bearing member and a plurality of weft yarns transverse to the length of the load bearing member, the woven fabric including a central portion and lateral edge portions extending along the length of the load bearing member, the central portion including the load bearing cords interlaced with the woven fabric, the lateral edge portions including terminal ends of the weft yarns, the central portion having a first plurality of warp yarns situated between laterally outermost ones of the cords, the lateral edge portions having a second plurality of warp yarns between the laterally outermost ones of the cords and the terminal ends of the weft yarns; and an adhesive that at least partially bonds the yarns together.

2. The elevator load bearing member of claim 1, wherein the warp yarns in the lateral edge portions interlock the weft yarns together.

3. The elevator load bearing member of claim 1, wherein at least some of the warp yarns in the lateral edge portions are interlocked with the weft yarns in a first manner and at least some others of the warp yarns in the lateral edge portions are interlocked with the weft yarns in a second, different manner.

4. The elevator load bearing member of claim 3, wherein the at least some of the warp yarns in the lateral edge portions are woven together with the weft fibers and the at least some others of the warp yarns in the lateral edge portions are stitched together with the weft fibers.

5. The elevator load bearing member of claim 1, wherein at least some of the yarns have a first melting temperature that is higher than a second melting temperature of at least some others of the yarns.

6. The elevator load bearing member of claim 5, wherein the at least some others of the yarns are at least partially melted thereby bonding the yarns together.

7. The elevator load bearing member of claim 1, wherein the woven fabric includes at least some thermoplastic that is at least partially melted.

8. The elevator load bearing member of claim 1, wherein the cords include a coating that is configured to at least partially melt and bond to the woven fabric.

9. An elevator load bearing member, comprising:

a plurality of load bearing cords; and a woven fabric including a plurality of warp yarns along a length of the load bearing member and a plurality of weft yarns transverse to the length of the load bearing member, the woven fabric including a central portion and lateral edge portions extending along the length of the load bearing member, the central portion including the load bearing cords interlaced with the woven fabric, the lateral edge portions including terminal ends of the weft yarns, the central portion having a first plurality of warp yarns situated between laterally outermost ones of the cords, the lateral edge portions having a second plurality of warp yarns between the laterally outermost ones of the cords and the terminal ends of the weft yarns, wherein the woven fabric includes at least some thermoplastic that is at least partially melted.

10. The elevator load bearing member of claim 9, wherein the warp yarns in the lateral edge portions interlock the weft yarns together.

11. The elevator load bearing member of claim 9, wherein at least some of the warp yarns in the lateral edge portions are interlocked with the weft yarns in a first manner and at least some others of the warp yarns in the lateral edge portions are interlocked with the weft yarns in a second, different manner.

12. The elevator load bearing member of claim 9, wherein at least some of the yarns have a first melting temperature that is higher than a second melting temperature of at least some others of the yarns; and the at least some others of the yarns are at least partially melted thereby bonding the yarns together.

13. The elevator load bearing member of claim 9, comprising an adhesive that at least partially bonds the yarns together.

14. The elevator load bearing member of claim 9, wherein the cords include a coating that is configured to at least partially melt and bond to the woven fabric.

15. An elevator load bearing member, comprising:

a plurality of load bearing cords; and a woven fabric including a plurality of warp yarns along a length of the load bearing member and a plurality of weft yarns transverse to the length of the load bearing member, the woven fabric including a central portion and lateral edge portions extending along the length of the load bearing member, the central portion including the load bearing cords interlaced with the woven fabric, the lateral edge portions including terminal ends of the weft yarns, the central portion having a first plurality of warp yarns situated between laterally outermost ones of the cords, the lateral edge portions having a second plurality of warp yarns between the laterally outermost ones of the cords and the terminal ends of the weft yarns, wherein at least some of the yarns have a first melting temperature that is higher than a second melting temperature of at least some others of the yarns and the at least some others of the yarns are at least partially melted thereby bonding the yarns together.

16. The elevator load bearing member of claim 15, wherein the warp yarns in the lateral edge portions interlock the weft yarns together.

17. The elevator load bearing member of claim 15, wherein at least some of the warp yarns in the lateral edge portions are interlocked with the weft yarns in a first manner and at least some others of the warp yarns in the lateral edge portions are interlocked with the weft yarns in a second, different manner.

18. The elevator load bearing member of claim 15, comprising an adhesive that at least partially bonds the yarns together.

19. The elevator load bearing member of claim 15, wherein the cords include a coating that is configured to at least partially melt and bond to the woven fabric.

20. The elevator load bearing member of claim 15, wherein the woven fabric includes at least some thermoplastic that is at least partially melted.

* * * * *